US008306446B2

(12) United States Patent
Ito et al.

(10) Patent No.: US 8,306,446 B2
(45) Date of Patent: Nov. 6, 2012

(54) IMAGE FORMING APPARATUS FOR COOLING A PRESSING MEMBER PRESSING AGAINST AN IMAGE HEATING MEMBER AND FORMING A NIP THEREBETWEEN

(75) Inventors: Yoshikuni Ito, Tokyo (JP); Toshinori Nakayama, Kashiwa (JP); Yasuharu Chiyoda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 254 days.

(21) Appl. No.: 12/772,360

(22) Filed: May 3, 2010

(65) Prior Publication Data

US 2010/0284706 A1 Nov. 11, 2010

(30) Foreign Application Priority Data

May 11, 2009 (JP) ..... 2009-114531

(51) Int. Cl.
*G03G 15/20* (2006.01)

(52) U.S. Cl. ..... 399/69; 399/329

(58) Field of Classification Search ..... 399/33, 399/38, 67–70, 122, 320, 328, 329
See application file for complete search history.

(56) References Cited

U.S. PATENT DOCUMENTS

| | | | | |
|---|---|---|---|---|
| 7,260,351 | B2 | 8/2007 | Nakayama | |
| 7,263,303 | B2 | 8/2007 | Nakayama | |
| 7,343,130 | B2 | 3/2008 | Nakayama | |
| 7,379,697 | B2 | 5/2008 | Ito et al. | |
| 7,428,390 | B2 * | 9/2008 | Ando | 399/67 |
| 7,430,392 | B2 | 9/2008 | Ito et al. | |
| 7,460,821 | B2 | 12/2008 | Ai et al. | |
| 7,505,724 | B2 | 3/2009 | Nakayama | |
| 7,590,366 | B2 | 9/2009 | Nakayama | |
| 7,729,628 | B2 | 6/2010 | Nakayama | |
| 7,761,044 | B2 * | 7/2010 | Yagi et al. | 399/329 |
| 7,965,955 | B2 * | 6/2011 | Takahashi et al. | 399/69 |
| 2009/0092409 | A1 | 4/2009 | Chiyoda et al. | |
| 2010/0202792 | A1 | 8/2010 | Nakayama | |

FOREIGN PATENT DOCUMENTS

| | | |
|---|---|---|
| CN | 101408747 A | 4/2009 |
| JP | 11-194647 | 7/1999 |

OTHER PUBLICATIONS

Chinese Office Action dated Jul. 26, 2011 in corresponding Chinese Application No. 201010178073.1, and English-language translation thereof.

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a rotatable heater for heating a toner image on a recording material in a nip; a rotatable pressor for pressing against the heater to form the nip; a moving mechanism for spacing the heater and the pressor from each other; a detector for detecting a temperature of the pressor; a cooler for cooling the pressor; a changer for changing the rotational speed of the pressor; and an executor for executing, when the temperature of the pressor reaches an upper limit temperature during execution of an image formation job of continuously forming the images, a cooling mode for cooling the pressor by the cooler in a state that the pressor and the heater are spaced from each other while rotating the pressing member at a second rotational speed higher than a first rotational speed which is a speed during the execution of the job.

15 Claims, 14 Drawing Sheets

| COOLING TIME | | PRESS.RLR | | PRESS.BELT | |
|---|---|---|---|---|---|
| | SPEED [mm/sec] | C.FAN | C.RLR | C.FAN | C.RLR |
| SAME | 250 | 2M | 1M30S | 1M15S | 50S |
| TWICE | 500 | 1M20S | 50S | 40S | 30S |
| THRICE | 750 | 1M | 35S | 30S | 20S |
| FOUR TIMES | 1000 | 40S | 25S | 20S | 15S |

FIG.6

IMAGE FORMING APPARATUS FOR COOLING A PRESSING MEMBER PRESSING AGAINST AN IMAGE HEATING MEMBER AND FORMING A NIP THEREBETWEEN

FIELD OF THE INVENTION AND RELATED ART

The present invention relates to an image heating apparatus for an image forming apparatus, such as a copying machine, a facsimile machine, a printer, or the like, for obtaining a hard copy by forming an image on a recording medium with the use of an electrophotographic method.

Conventional electrophotographic image forming apparatuses use a fixing apparatus (image heating apparatus) which employs a pair of heat rollers, more specifically, a heat roller (image heating member) and a pressure roller to fix toner to the recording medium. In recent years, however, the thermal fixing apparatuses, such as the above-described one, have been having a problem when they are used for fixing toner to coated printing paper, which has come to be widely available in the market. More specifically, as they are used to fix toner to coated printing paper, toner blisters, that is, blisters traceable to toner, and/or paper blisters, that is, blisters traceable to the printing paper itself, form as toner is fixed. Further, after the discharging of a two-sided copy from the image forming apparatuses, the two surfaces of the two-sided copy appear different in glossiness.

Coated printing paper is made by coating both surfaces of sheet of recording medium with resin. The surfaces of coated printing paper are glossier than those of the high quality paper (or ordinary paper) used in ordinary offices. If an excessive amount of heat is given to coated printing paper while toner is fixed to coated printing paper, toner blisters and/or paper blisters are sometimes formed. A toner blister is a blister which forms as the toner layer on the recording medium is pushed up by the steam generated from the moisture in the recording medium by the abovementioned excessive amount of heat. A paper blister is a blister which forms as the sublayer and/or sublayers of the recording medium, and/or resin layer is made to separate from each other by the increase in volume (evaporation) of the moisture in the recording medium, which is caused by the above-mentioned excessive amount of heat. Further, when the image forming apparatus is in the two-sided printing mode, the toner image on the first surface of the recording medium is subjected to fixation heat twice, being thereby increased in glossiness. Thus, if a pamphlet is made by printing on both surfaces of a recording medium, the first page appears different in glossiness from the second page. Thus, more than a few inventions are made to prevent the formation of the toner blister and paper blister, and also, to prevent an electrophotographic image forming apparatus from yielding a print (copy), the two surfaces of which are different in glossiness, when it is used in the two-sided printing mode. One of such inventions is disclosed in Japanese Laid-open Patent Application H11-194647.

The invention disclosed in Japanese Laid-open Patent Application H11-194647 is related to a fixing apparatus which sets the target temperature for its pressing member several tens of degrees lower than that for its image heating member. Further, when reducing the pressing member of this fixing apparatus in temperature, the fixing apparatus pulls the pressing member away from the image heating member, and continuously rotates the pressing member. This structural arrangement can reduce the amount of heat applied to recording medium from the backside of the recording medium. Therefore, it is thought that the employment of this structural arrangement can prevent the formation of toner blister and paper blister. It is also thought that the employment of this structural arrangement can prevent the image forming apparatus from yielding a copy, the two surfaces of which are different in glossiness, when it is in the two-side printing mode.

However, the invention disclosed in Japanese Laid-open Patent Application H11-194647 is unsatisfactory in that it cannot completely prevent the formation of toner blisters and paper blisters. Next, the reason why this invention cannot completely prevent the formation of toner blisters and paper blisters will be described referring to FIGS. 13 and 14.

Part (a) of FIG. 13 is a graph which shows that an "area having recording medium" and an "area having no recording medium" are alternately and regularly moved through the fixing apparatus. Part (b) of FIG. 13 is a graph which shows the temperature fluctuation of the pressure roller, which occurs when a substantial number of prints (copies) are continuously printed.

Referring to part (a) of FIG. 13, which is related to an image forming operation in which a substantial number of prints (copies) are continuously printed, and therefore, it is assumed that the "area having recording medium" and "area having no recording medium" are alternately and regularly repeated. The "area having no recording medium" may sometimes be referred to as a "recording medium interval". The length of the "area with no recording medium" may be sometimes referred to as the "distance between two successive recording media. In the "area having recording medium", the heat of the pressure roller is allowed to escape to the recording medium. In the "area having no recording medium", the heat of the pressure roller is not allowed to escape to the recording medium; it is retained by the pressure roller.

Therefore, while the "area having recording medium" moves through the fixation nip, the temperature of the pressure roller drops a little, whereas when the "area having no recording medium" moves through the fixation nip, the temperature of the pressure roller increases a little, as shown in (b) of FIG. 13. In this case, the amount of heat supplied from the fixation roller to the pressure roller is roughly the same as the amount of heat which escapes from the pressure roller to the recording medium. That is, the pressure roller is in the state of thermal equilibrium; it is stable in temperature. In other words, the pressure roller is controlled in temperature so that its temperature remains within a preset range.

Part (b) of FIG. 14 is a graph which shows that the "area with no recording medium" is irregularly moved through the fixing apparatus. Part (b) of FIG. 14 is a graph which shows the temperature fluctuations of the pressure roller, which occurred in a printing operation in which recording media are conveyed through the fixation nip with irregular intervals. Referring to FIG. 14(*a*), recording medium intervals sometimes increase even in an operation in which a substantial number of prints (copies) are continuously made.

Thus, while the "area having recording medium" is moving through the fixation nip, the temperature of the pressure roller falls a little, whereas while the "area having no recording medium" is moving through the fixation nip, the temperature of the pressure roller climbs, as shown (b) of FIG. 14. More specifically, in this case, the length of time it takes for the "area having no recording medium" to pass through the fixation nip is long. Therefore, even if the power source of the fixing apparatus is turned off, the temperature of the pressure roller continues to increase because of the heat transfer from the fixation roller to the pressure roller. Thus, if the temperature sensor with which the pressure roller is provided detects that the pressure roller temperature reached its top limit, the pressure roller is pulled away from the fixation roller to allow the pressure roller to cool. The time it takes to cool the pressure roller is downtime (non-fixation period).

From the standpoint of improving an electrophotographic image forming apparatus in usability, the downtime of the electrophotographic image forming apparatus is desired to be as short as possible which occurs during an image forming operation in which a substantial number of prints are to be continuously outputted.

SUMMARY OF THE INVENTION

Accordingly, an object of the present invention is to provide an image heating apparatus which has a substantially shorter length of time required to cool its overheated pressing member than any of the conventional image heating apparatuses.

According to an aspect of the present invention, there is provided an image forming apparatus comprising a rotatable image heating member for heating a toner image on a recording material in a nip; a rotatable pressing member for pressing against the image heating member to form the nip; a moving mechanism for relative movement between the heating member and the pressing member toward and away from each other; a temperature detecting member for detecting a temperature of the pressing member; cooling means for cooling the pressing member; rotational speed changing means for changing a rotational speed of the pressing member; and an executing portion for executing, when the temperature of the pressing member reaches an upper limit temperature during execution of an image formation job of continuously forming the images, a cooling mode for cooling the pressing member by the cooling means in a state that the pressing member and the heating member are spaced from each other while rotating the pressing member at a second rotational speed higher than a first rotational speed which is a speed during the execution of the job.

These and other objects, features, and advantages of the present invention will become more apparent upon consideration of the following description of the preferred embodiments of the present invention, taken in conjunction with the accompanying drawings.

Figure 5:
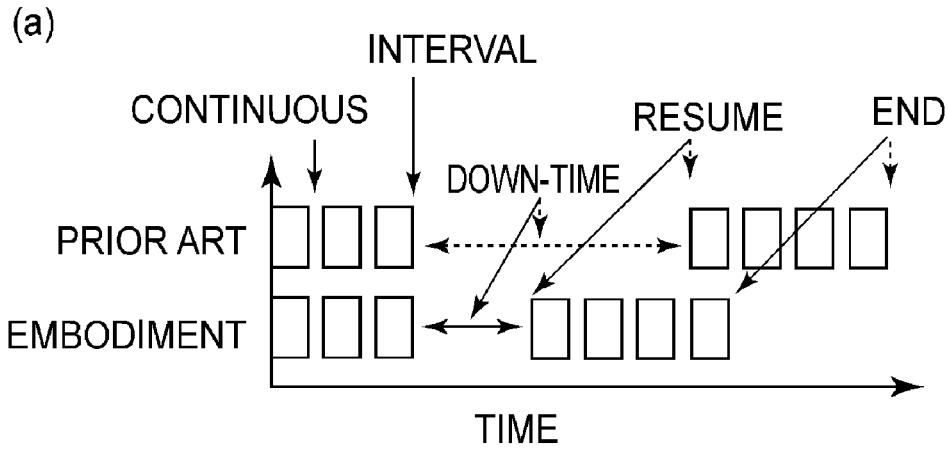
Figure 5:
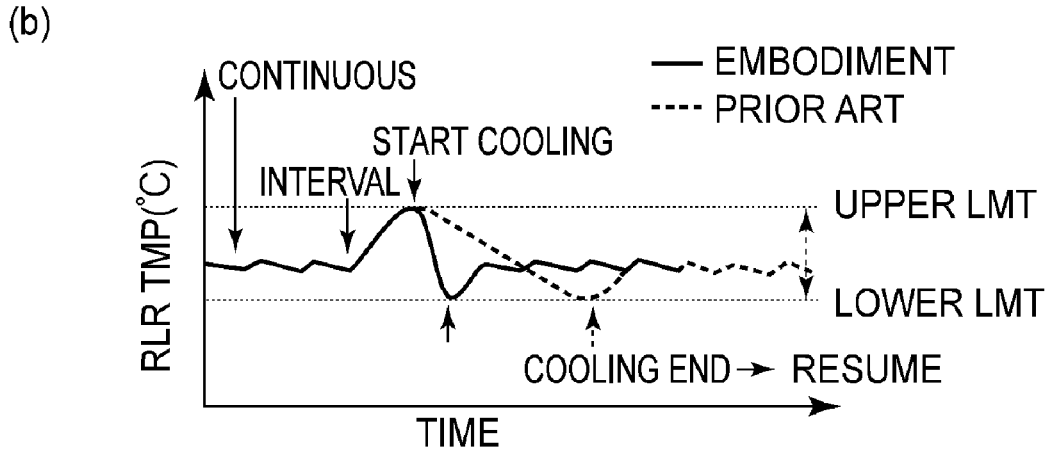

Part (a) of FIG. 5 is a drawing for showing the difference between the fixing apparatus in the first embodiment and a typical conventional fixing apparatus, in terms of the length of time (downtime) required to cool the pressing member, as necessary, during one of the recording medium intervals in an image forming operation in which a substantial number of prints are continuously made. Part (b) of FIG. 5 is a graph which shows the temperature fluctuation of the pressing roller which occurs during the recording medium intervals in an image forming operation in which a substantial number of prints are continuously made.

FIG. 6 is a table which shows the length of time (downtime) necessary to cool the pressing members in an image forming operation in which a substantial number of prints are continuously made.

Figure 7:
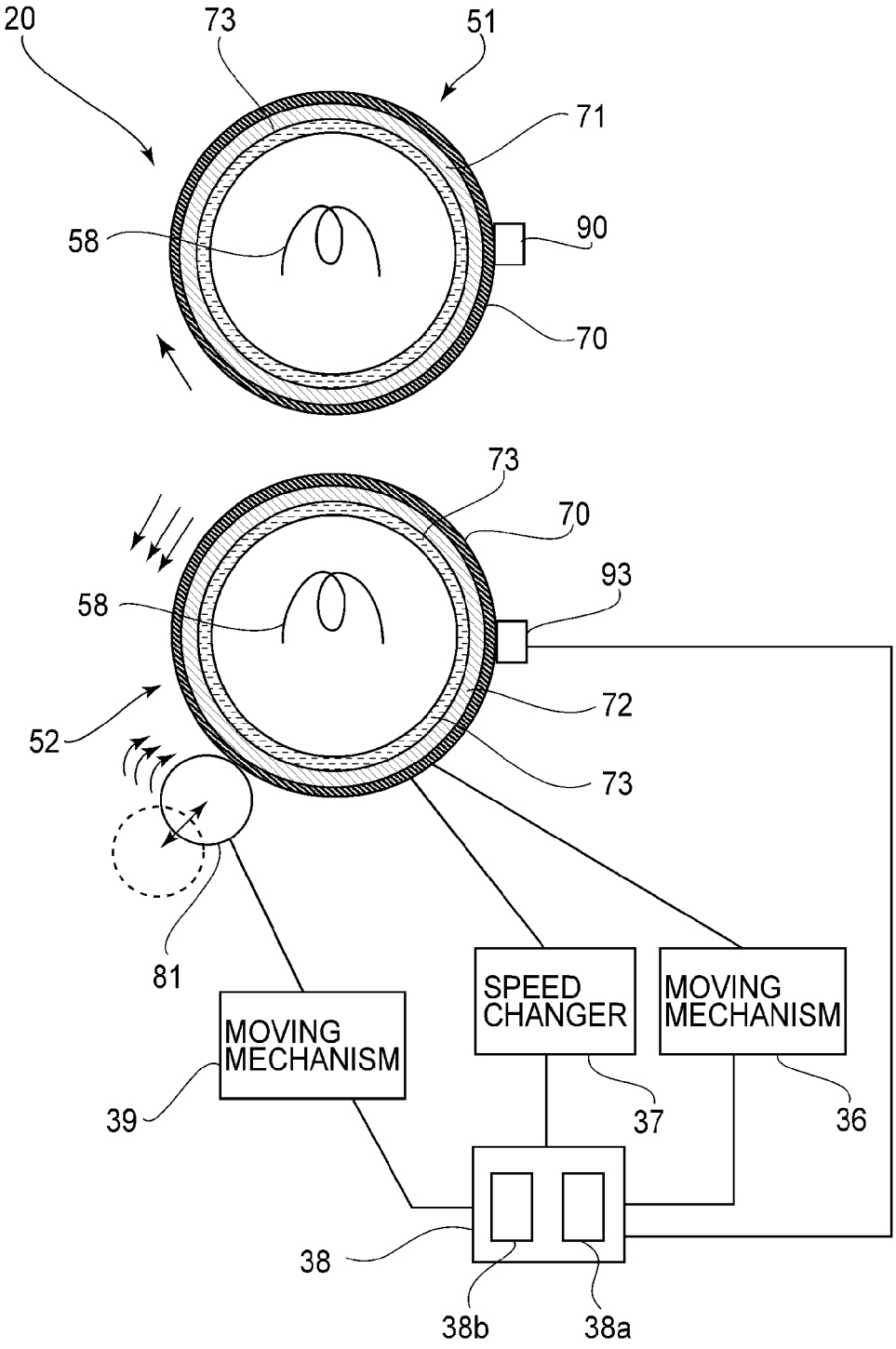

FIG. 7 is a sectional view of the fixing apparatus in the second embodiment of the present invention, and shows the structure of the apparatus.

Figure 8:
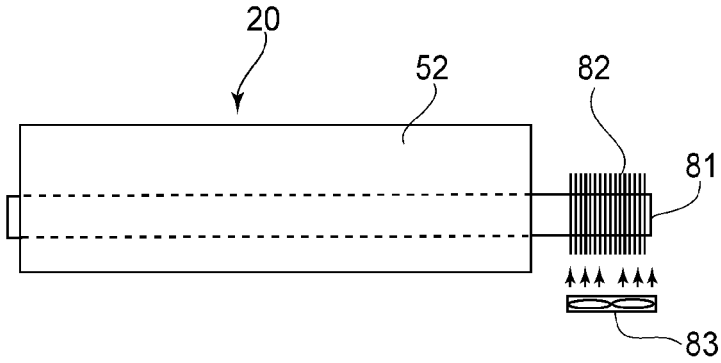

FIG. 8 is a plan view of the pressure roller in the second embodiment of the present invention, as seen from the direction of the fixation roller.

Figure 9:
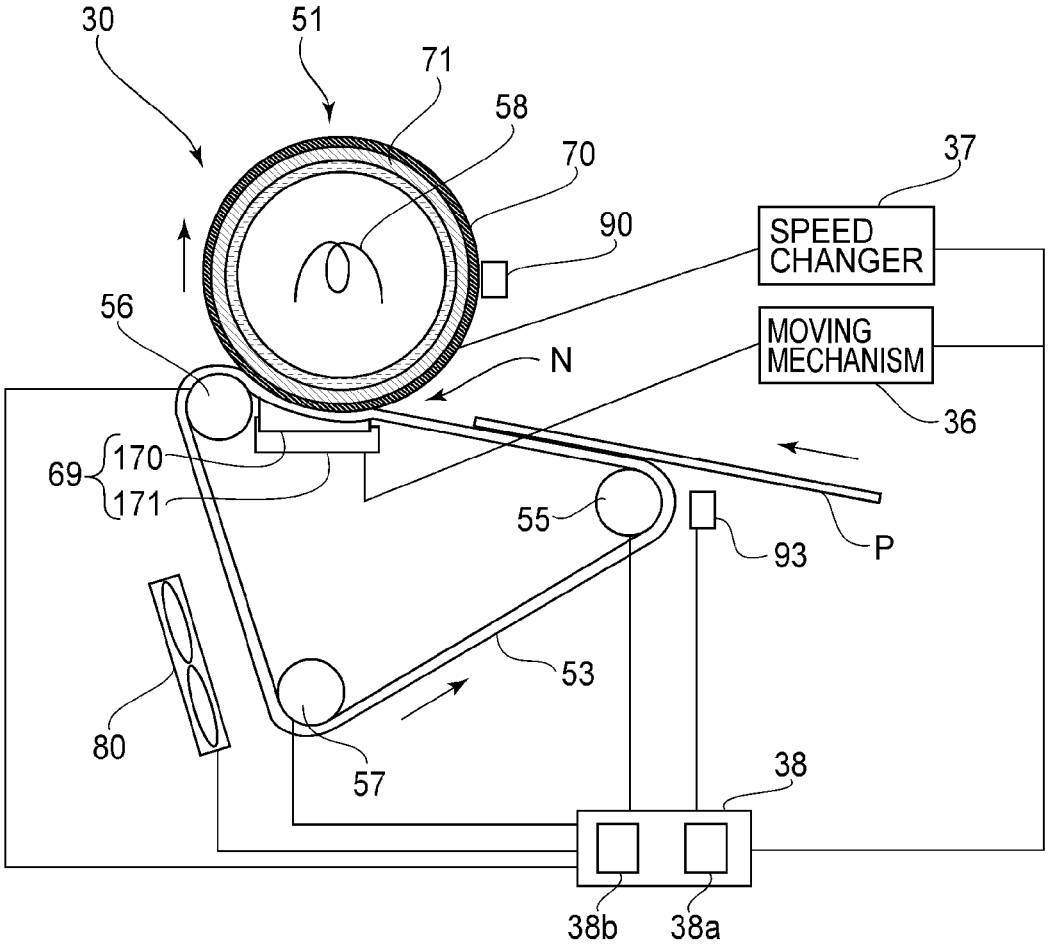

FIG. 9 is a sectional view of the fixing apparatus in the third embodiment of the present invention, and shows the structure of the apparatus.

Figure 10:
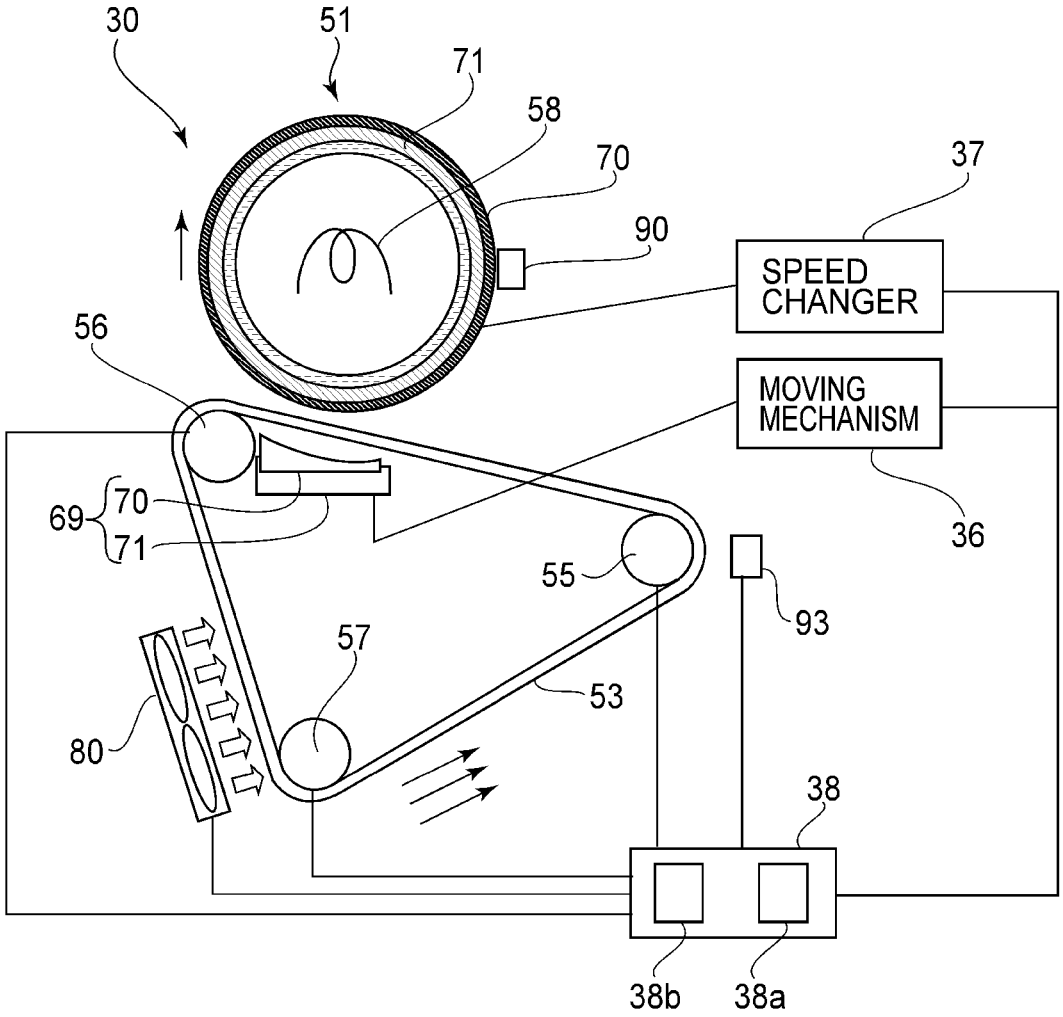

FIG. 10 is a sectional view of the fixing apparatus in the third embodiment of the present invention, and shows the process for placing the pressing member in contact with, or moving away from, the fixation roller.

Figure 11:
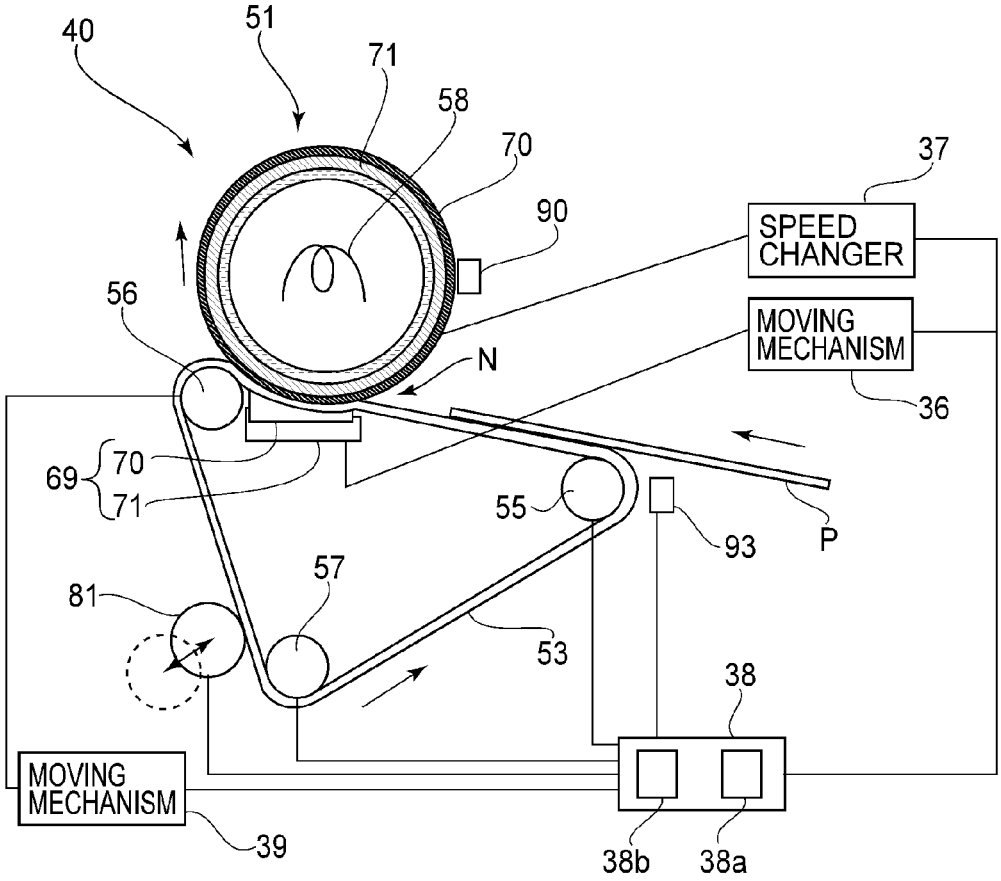

FIG. 11 is a sectional view of the fixing apparatus in the fourth embodiment of the present invention, and shows the structure of the apparatus.

Figure 12:
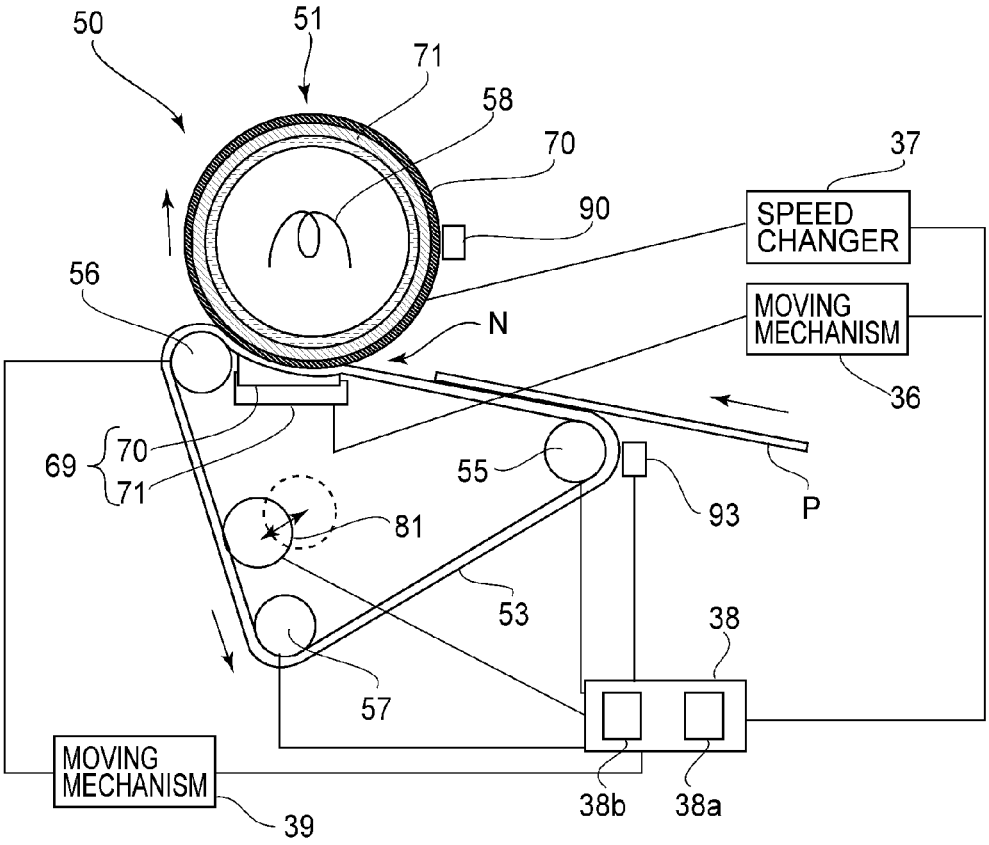

FIG. 12 is a sectional view of one of the modified versions of the fixing apparatus shown in FIG. 11.

Figure 13:
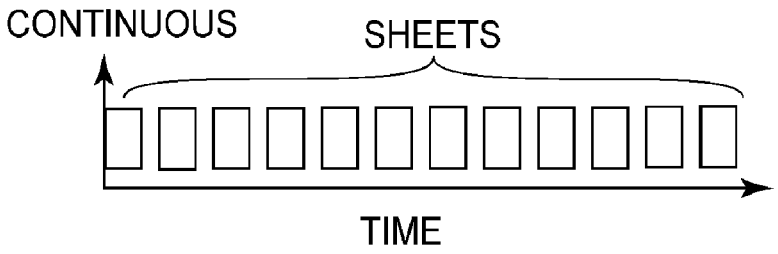
Figure 13:
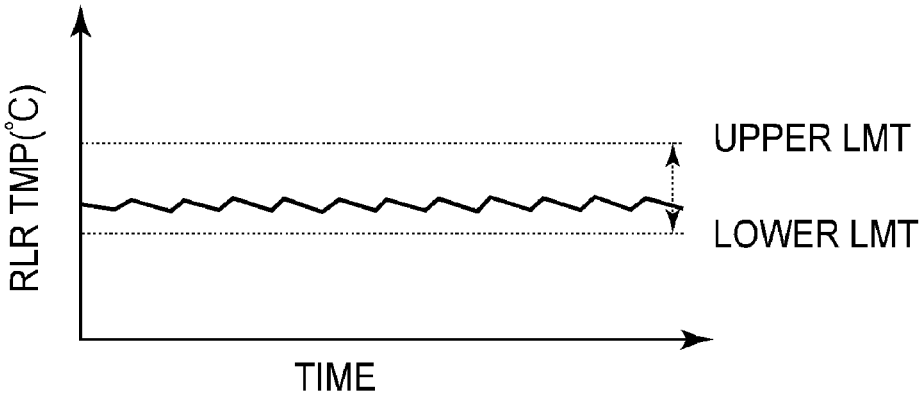

FIG. 13 is a drawing which schematically shows the sheets of recording mediums which are being conveyed with equal intervals. Part (b) of FIG. 13 is a graph which shows the temperature fluctuation of the pressing member, which occurs in an image forming apparatus in which a substantial number of prints are continuously made, and in which sheets of recording medium are conveyed with equal intervals.

Figure 14:
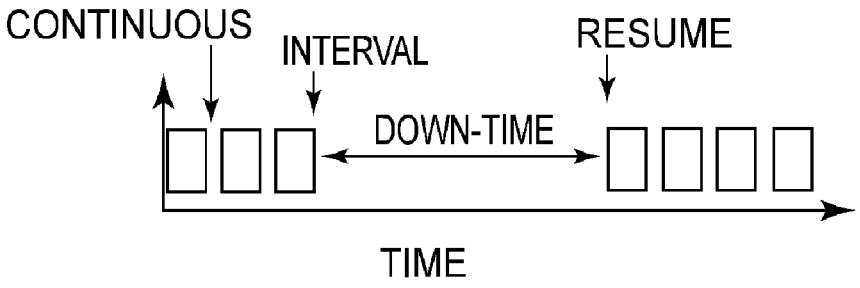
Figure 14:
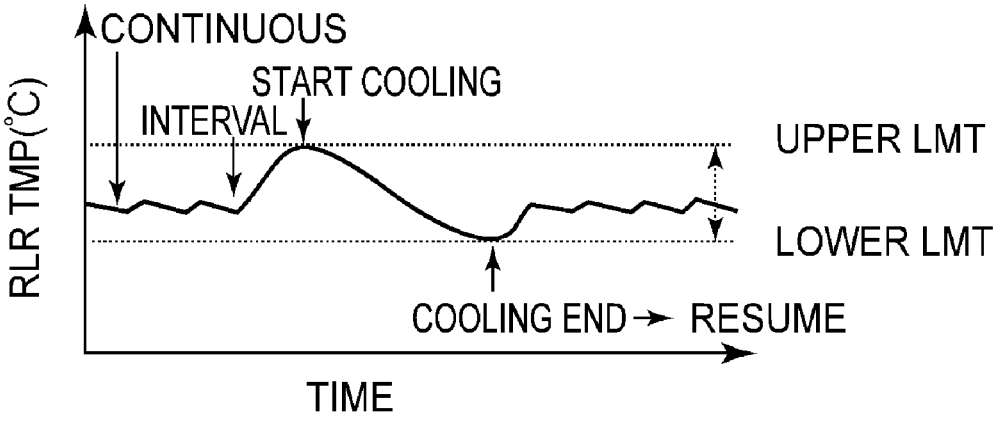

FIG. 14 is a drawing which schematically shows one of the intervals of sheets of recording medium, which has to be extended to cool the pressing member, in an image forming operation in which a substantial number of prints are continuously made.

Figure 15:
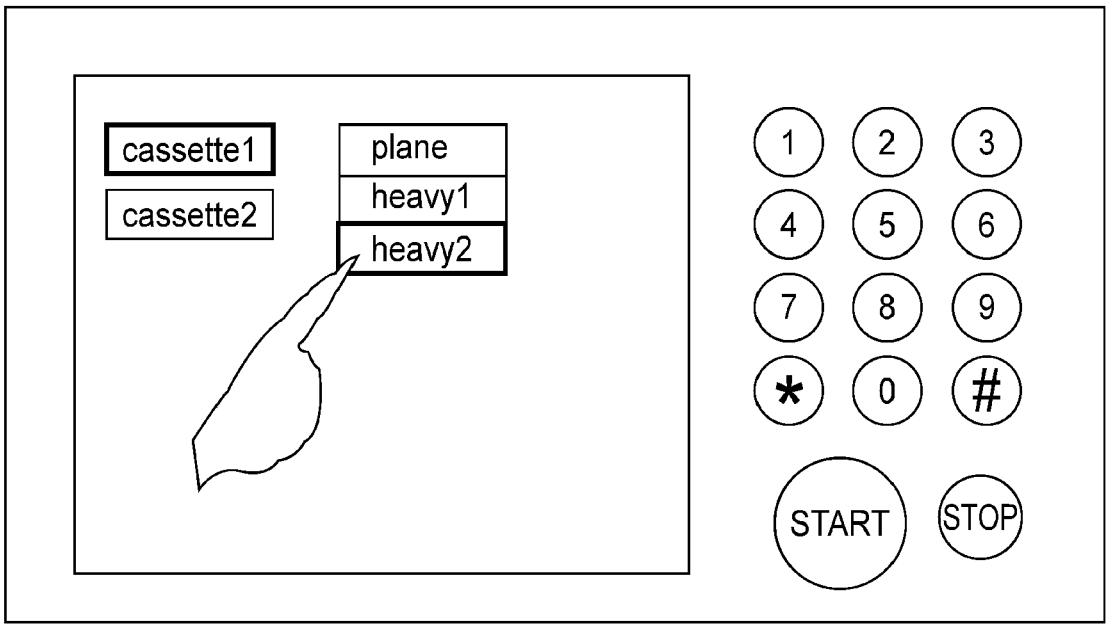

FIG. 15 is a drawing of the control panel of one of the image forming apparatuses in accordance with the present invention.

DETAILED DESCRIPTION OF THE PREFERRED EMBODIMENTS

Hereinafter, the preferred embodiments of the present invention will be described with reference to the appended drawings. Incidentally, the measurements, materials, shapes, etc., of the structural components of the fixing apparatus and image forming apparatus in the following embodiments of the present invention, and their positional relationship, are not intended to limit the present invention in scope, unless specifically noted. Further, in a case where an item in any of the following drawings is denoted by the same reference characters as an item in another drawing, the two items are the same in structure or function, and therefore, their structures and functions will be described only once.

Embodiment 1

Figure 1:
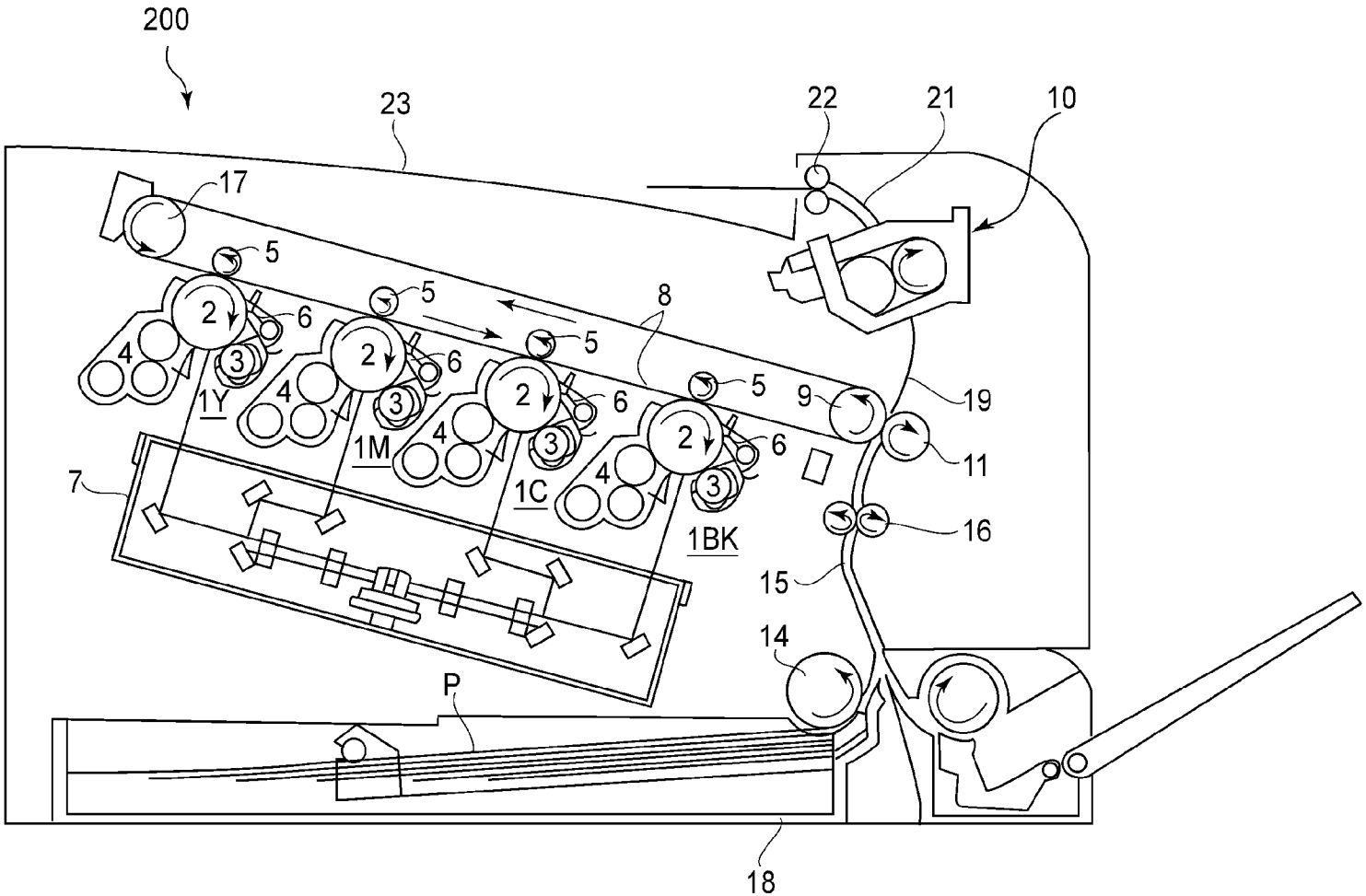
FIG. 1 is a sectional view of the image forming apparatus having the fixing apparatus in the first embodiment of the present invention, and shows the structure of the image forming apparatus.

Next, the first embodiment of the present invention will be described. FIG. 1 is a sectional view of the image forming apparatus 200 in the first embodiment of the present invention, and shows the structure of the apparatus 200. The apparatus 200 has a fixing apparatus 10 which is an image heating apparatus in accordance with the present invention. Referring to FIG. 1, the image forming apparatus 200 has: a recording medium storage 18, in which sheets of a recording medium P can be stored in layers; a sheet feeding-and-conveying roller 14; and a sheet conveying vertical path 15.

The image forming apparatus 200 has also an intermediary transfer belt 8, which is on the downstream side of the sheet conveyance vertical path 15 in terms of the direction in which the recording medium P is conveyed. The intermediary transfer belt 8 is suspended, being thereby stretched, by rollers 9 and 17. The roller 9 functions also as a backup roller for backing up the intermediary transfer belt 8 against a second transfer roller 11. More specifically, the second transfer roller 11 is kept pressed against the back roller 9 with the presence of the intermediary transfer belt 8 between the two rollers 11 and 9. The interface between the intermediary transfer belt 8 and second transfer roller 11 is the second transfer portion.

The image forming apparatus 200 has four image forming portions 1 (1Y, 1M, 1C, and 1Bk), which are disposed along the intermediary transfer belt 8 with preset intervals. Each image forming portion 1 has a photosensitive drum 2 which rotates in the clockwise direction indicated by an arrow mark. The interface between the photosensitive drum 2 and intermediary transfer belt 8 is the first transfer portion. The image forming apparatus 200 has also a primary charging device 3, a developing apparatus 4, a transfer roller 5, and a drum cleaning apparatus 6, which are disposed in the listed order in the adjacencies of the peripheral surface of the photosensitive drum 2. The image forming apparatus 200 has also an exposing apparatus 7, which exposes the peripheral surface of the photosensitive drum 2. The light source of the exposing apparatus 7 is a laser.

The image forming apparatus 200 has also a vertical guide 19, a fixing apparatus 10, a recording medium conveyance path 21, and a pair of discharge rollers 22, which are on the downstream side of the second transfer portion in terms of the direction in which the recording medium P is conveyed.

As a command for starting an image forming operation is issued from the unshown control portion of the image forming apparatus 200, the sheet feeding-and-conveying roller 14 is driven, whereby the recording media P are conveyed one by one to a pair of registration rollers 16 through the sheet conveyance vertical path 15. Then, toner images are formed on the photosensitive drums 2 of the four image forming portions 1, one for one, and are sequentially transferred in layers onto the intermediary transfer belt 8, effecting thereby an unfixed full-color toner image on the intermediary transfer belt 8. As the recording medium P is conveyed through the second transfer portion, the unfixed full-color toner image on the intermediary transfer belt 8 is transferred onto the recording medium P. Then, the recording medium P is guided to the fixing apparatus 10 by the vertical guide 19. In the fixing apparatus 10, the toner particles in the unfixed full-color image are fixed, while being mixed, to the recording medium P. As a result, a permanent full-color image is effected on the recording medium P. Thereafter, the recording medium P is conveyed through the sheet conveyance path 21, and is discharged, as a full-color print, into a delivery tray 23 by the pair of discharge rollers 22.

The image forming apparatus 200 structured as described above is capable of continuously making multiple prints (copies). Thus, the fixing apparatus 10 is capable of continuously fixing multiple unfixed toner images.

Figure 2:
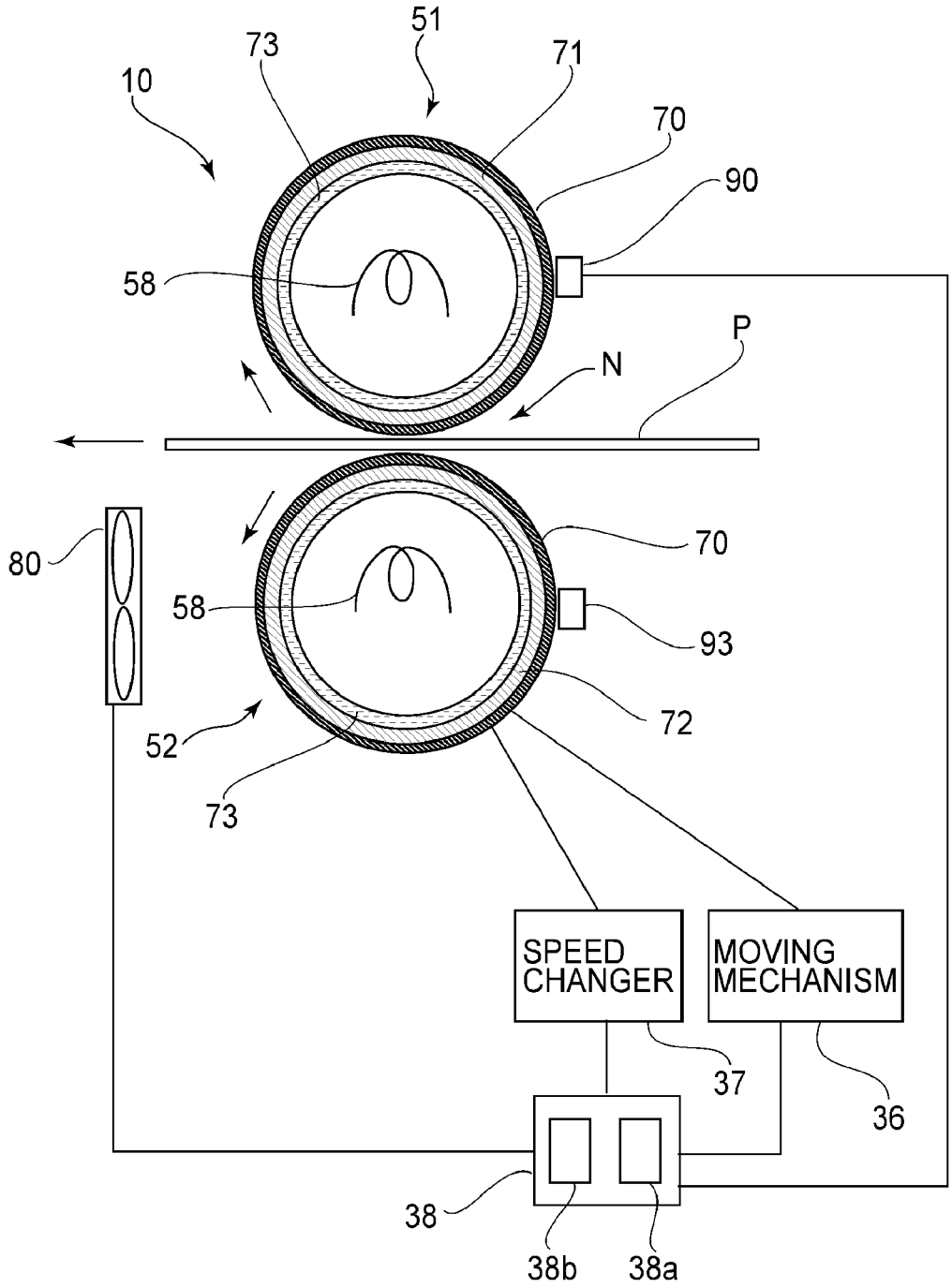
FIG. 2 is a sectional view of the fixing apparatus in the first embodiment of the present invention, and shows the structure of the apparatus.

FIG. 2 is a sectional view of the fixing apparatus 10 in the first embodiment of the present invention, and shows the structure of the fixing apparatus 10. Referring to FIG. 2, the fixing apparatus 10, which is an image heating apparatus, has a fixation roller 51 and a pressure roller 52. The fixation roller 51 is an image heating member, and is rotatable. The pressure roller 52 is a pressure applying member, and is also rotatable. The recording medium P is conveyed between the fixation roller 51 and pressure roller 52 while remaining sandwiched by the two rollers. The interface between the fixation roller 51 and pressure roller 52 is a fixation nip N, or a heating nip.

The fixation roller 51 is a rotatable member, and heats the toner image on the recording medium P, in the fixation nip N. It is roughly 80 mm, for example, in external diameter. More specifically, the fixation roller 51 is made up of a hollow metallic core 73, a pad supporting portion 71, and a pad 70. The hollow metallic core 73 is 75.0 mm in external diameter, and 3.0 mm in thickness. The pad supporting portion 71 is 2.5 mm in thickness, and made of silicone rubber, which is 20° in hardness (JIS-Alkg). It covers the peripheral surface of the metallic core 73. The pad 70 is a piece of PFA tube, and is 10-100 μm in thickness. It covers the pad supporting portion 71. There is a halogen heater 58, as a heat source, in the hollow of the fixation roller 51. The temperature of the fixation roller 51 is controlled by a temperature sensor 90 and an unshown temperature control circuit so that the surface temperature of the fixation roller 51 remains at 180° C. That is, the halogen heater 58 is controlled by the temperature control circuit so that the temperature of the fixation roller 51 climbs to 180° C., and remains at 180° C.

The pressure roller 52 is a rotatable member, and forms the fixation nip N by being placed in contact with the fixation roller 51. It is roughly 80 mm, for example, in external diameter. More specifically, the pressure roller 52 is made up of a hollow metallic core 73, an elastic layer 72, and a pad 70. The hollow metallic core 73 is 75.0 mm in external diameter, and 3.0 mm in thickness. The elastic layer 72 is 2.0 mm in thickness, and made of silicone rubber which is 20° in hardness (JIS-Alkg). It covers the peripheral surface of the metallic core 73. The pad 70 is a piece of PFA tube, and is 10-100 μm in thickness. It covers the elastic layer 72. There is a halogen heater 58, as a heat source, in the hollow of the pressure roller 52. The temperature of the pressure roller 52 is controlled by a temperature sensor 93 and an unshown temperature control circuit so that the surface temperature of the pressure roller 52 remains at 120° C. That is, the halogen heater 58 is controlled by the temperature control circuit so that the temperature of the pressure roller 52 climbs to 120° C., and remains at 120° C.

The pressure roller 52 is kept pressed upon the fixation roller 51 with the application of a total pressure of 700-1,500 N. It is rotated by the rotation of the fixation roller 51. The nip (fixation nip) between the pressure roller 52 and fixation roller 51 is roughly 10 mm, for example, in terms of the recording medium conveyance direction. The fixation roller 51 is a component for fixing toner to the recording medium P. The pressure roller 52 is a component for forming the fixation nip N, that is, a heating nip, by being pressed upon the fixation roller 51.

The fixation roller 51 and pressure roller 52 are rotated in the direction indicated by arrow marks. The pressure roller 52 can be pulled away from the fixation roller 51 by a pressure roller moving mechanism 36. When the image forming apparatus 200 is actually forming an image (printing copy), the pressure roller 52 is kept pressed upon the fixation roller 51 by the application of the abovementioned amount of pressure to the pressure roller 52, so that the nip (fixation nip) is maintained between the pressure roller 52 and fixation roller 51. After the completion of the fixing operation, the pressure roller 52 is pulled away from the fixation roller 51, and is kept on standby. Since this fixing apparatus 10 is structured so that the pressure roller 52 can be separated from the fixation roller 51, not only can the target temperature of the fixation roller 51 be set to a level different from the one for the pressure roller 52, but also, it is possible to prevent the layers of the fixation roller 51 and pressure roller 52, which are formed of rubber, from being permanently deformed (C set). In other words, this structural arrangement offers an effect of improving the fixing apparatus 10 in durability. As described above, the fixing apparatus 10 is such a fixing apparatus, whose fixation roller 51 and pressure roller 52 can be placed in contact with, or separated from, each other.

The fixing apparatus 10 is provided with a cooling fan 80, which cools the pressure roller 52 by blowing cold air at the pressure roller 52. The cooling fan 80 is set up so that the air flow generated by the cooling fan 80 is aimed toward the pressure roller 52. It is in the adjacencies of the pressure roller 52. In this embodiment, the fixing apparatus 10 (image forming apparatus 200) is designed so that the cooling fan 80 operates only when the fixing apparatus 10 (image forming apparatus 200) is in the cooling mode; it does not operate while images are heated.

The pressure roller 52 is connected to the pressure roller moving mechanism 36 and a pressure roller speed varying mechanism 37. The mechanism 36 is a mechanism for moving the pressure roller 52 to adjust the distance between the pressure roller 52 and fixation roller 51. Thus, it is structured so that not only can it move the pressure roller 52 close to the fixation roller 51 (and place pressure roller 52 in contact with fixation roller 52), but also, it can move the pressure roller 52 away from the fixation roller 51. The mechanism 37 is a mechanism that can change in steps the rotational speed of the pressure roller 52 to one of preset speeds. The cooling fan 80, the pressure roller moving mechanism 36, and the pressure roller speed varying mechanism 37 are connected to the controller 38.

The controller 38 has a pressure roller temperature determining portion 38*a* and a pressure roller controlling portion 38*b*. The portion 38*a* detects the temperature of the pressure roller 52. The portion 38*b* controls the pressure roller 52 in response to the temperature of the pressure roller 52, which is detected by the temperature sensor 93. More specifically, when the temperature of the pressure roller 52 is no higher than a preset level (upper limit, for example, of pressure roller temperature range), the portion 38*b* makes the pressure roller speed varying mechanism 37 drive the pressure roller 52 at the first driving speed, which is the driving speed at which the pressure roller 52 is to be rotated to fix toner to the recording medium P.

On the other hand, if the temperature of the pressure roller 52 detected by the temperature sensor 93 is no less than a preset level (upper limit, for example), the pressure roller condition controlling portion 38*b* determines that the fixing apparatus 10 is to be operated in the cooling mode, that is, the mode in which the pressure roller 52 is cooled. Then, the portion 38*b* moves the pressure roller 52 away from the fixation roller 51 by driving the pressure roller moving mechanism 36. Then, the pressure roller condition controlling portion 38*b* makes the rotational speed varying mechanism 37 drive the pressure roller 52 at the second driving speed, which is faster than the first driving speed of the pressure roller 52, which is the first rotational speed of the pressure roller 52. That is, if the temperature of the pressure roller 52 detected by the temperature sensor 93 is no less than a preset level, the portion 38*b* increases the pressure roller 52 in rotational speed, making thereby the pressure roller 52 rotate faster than when the toner image on the recording medium P is heated in the fixation nip N. Therefore, when the pressure roller 52 is placed in contact with the fixation roller 51 the next time to heat the toner image on the recording medium P, the temperature of the pressure roller 52 is lower than that of the fixation roller 51.

At this time, the pattern in which the pressure roller 52 is changed in rotational speed will be described.

(1) If an image forming operation in which images are continuously fixed to recording media by an image heating apparatus at the highest rotational speed is interrupted to put the fixing apparatus in the cooling mode, the rotational speed of the pressure roller 52 is set to a rotational speed which is higher than the maximum rotational speed for image heating. This rotational speed is such a rotational speed that is not used for image heating. That is, it is a rotational speed dedicated to the cooling of the pressure roller 52. The reason why the fixing apparatus 10 is designed so that when the apparatus is the cooling mode, its pressure roller 52 can be rotated at the rotational speed dedicated to the cooling of the pressure roller 52 is as follows:

(2) In a case where the image forming apparatus 200 is provided with a control portion capable of making the fixing apparatus 10 heat images at the first rotational speed (first image formation mode or first image heating mode) or the second rotational speed (second image formation mode or second image heating mode) which is slower than the first rotational speed, and an image forming operation in which images are continuously fixed to the recording mediums P by an image heating apparatus in the first image formation mode is interrupted to put the fixing apparatus in the cooling mode, the rotational speed of the pressure roller 52 is switched to the rotational speed dedicated to cooling. On the other hand, if an image forming operation in which images are continuously fixed to recording mediums P by an image heating apparatus at the second rotational speed is interrupted to put the fixing apparatus in the cooling mode, the rotational speed of the pressure roller 52 is switched to the first rotational speed. Incidentally, the image forming apparatus 200 may be designed so that in a case where an image forming operation in which images are continuously fixed to recording media P by an image heating apparatus in the second image formation mode is interrupted to put the fixing apparatus in the cooling mode, the rotational speed of the pressure roller 52 can be switched to the second rotational speed or the abovementioned rotational speed dedicated to cooling.

When the image forming apparatus 200 is in the cooling mode, the pressure roller condition controlling portion 38*b* drives the cooling fan 80 to cool the pressure roller 52. While the pressure roller 52 is cooled by the cooling fan 80, the pressure roller 52 is rotated at a speed higher than the speed at which it is rotated while images are formed.

Figure 3:
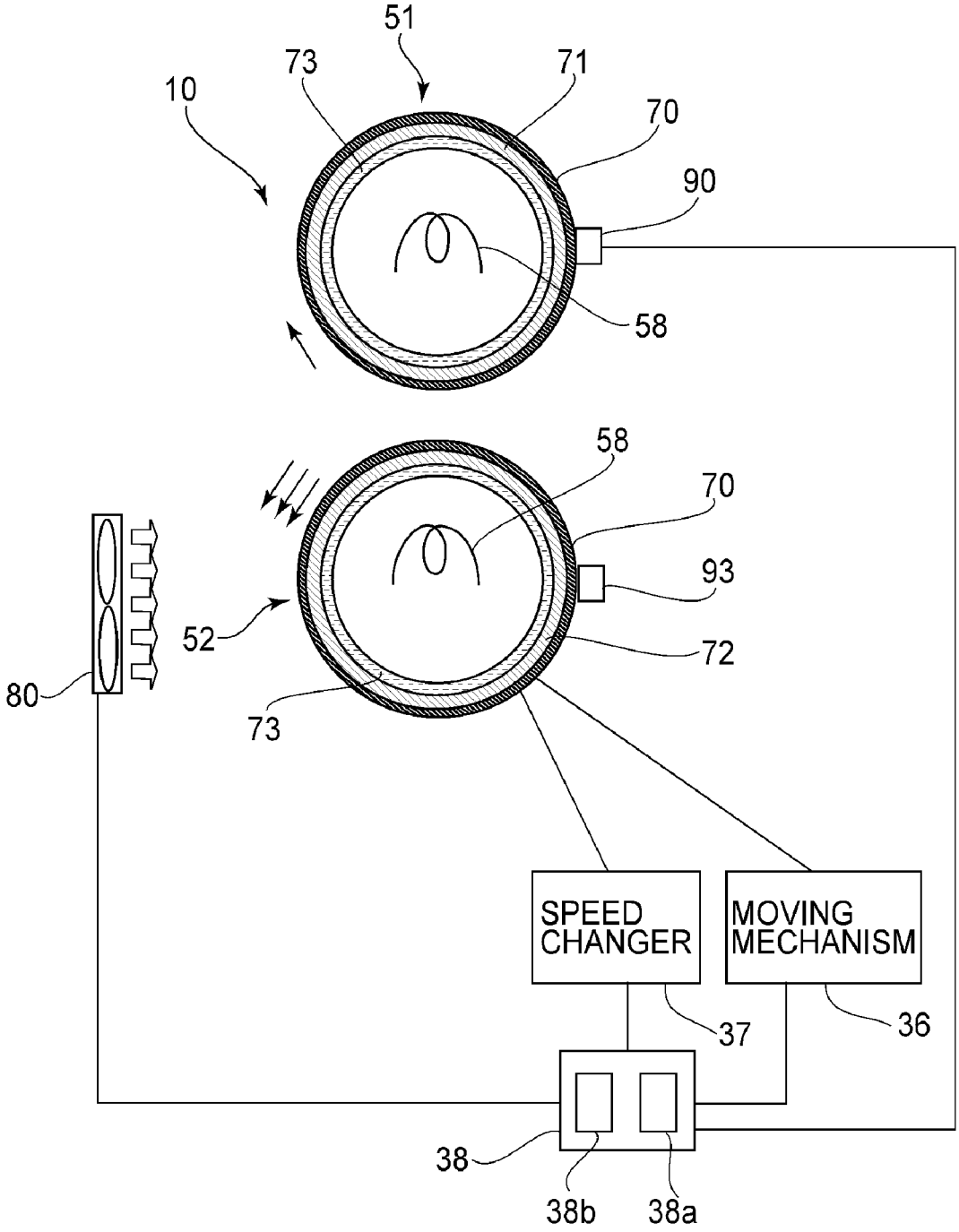
FIG. 3 is a sectional view of the fixing apparatus in the first embodiment of the present invention, and shows the state of the apparatus when the apparatus is in the cooling mode (after separation of pressing member from fixation roller).

FIG. 3 is a schematic sectional view of the fixing apparatus 10, and shows the state of the fixing apparatus 10, in which the pressure roller 52 has been moved away from the fixation roller 51. Referring to FIG. 3, as soon as the pressured roller 52 is moved to a preset position in which the distance between the fixation roller 52 and fixation roller 51 is farthest, the pressure roller 52 begins to be rotated at the abovementioned high speed, and the cooling fan 80 begins to be rotated to cool the pressure roller 52.

Figure 4:
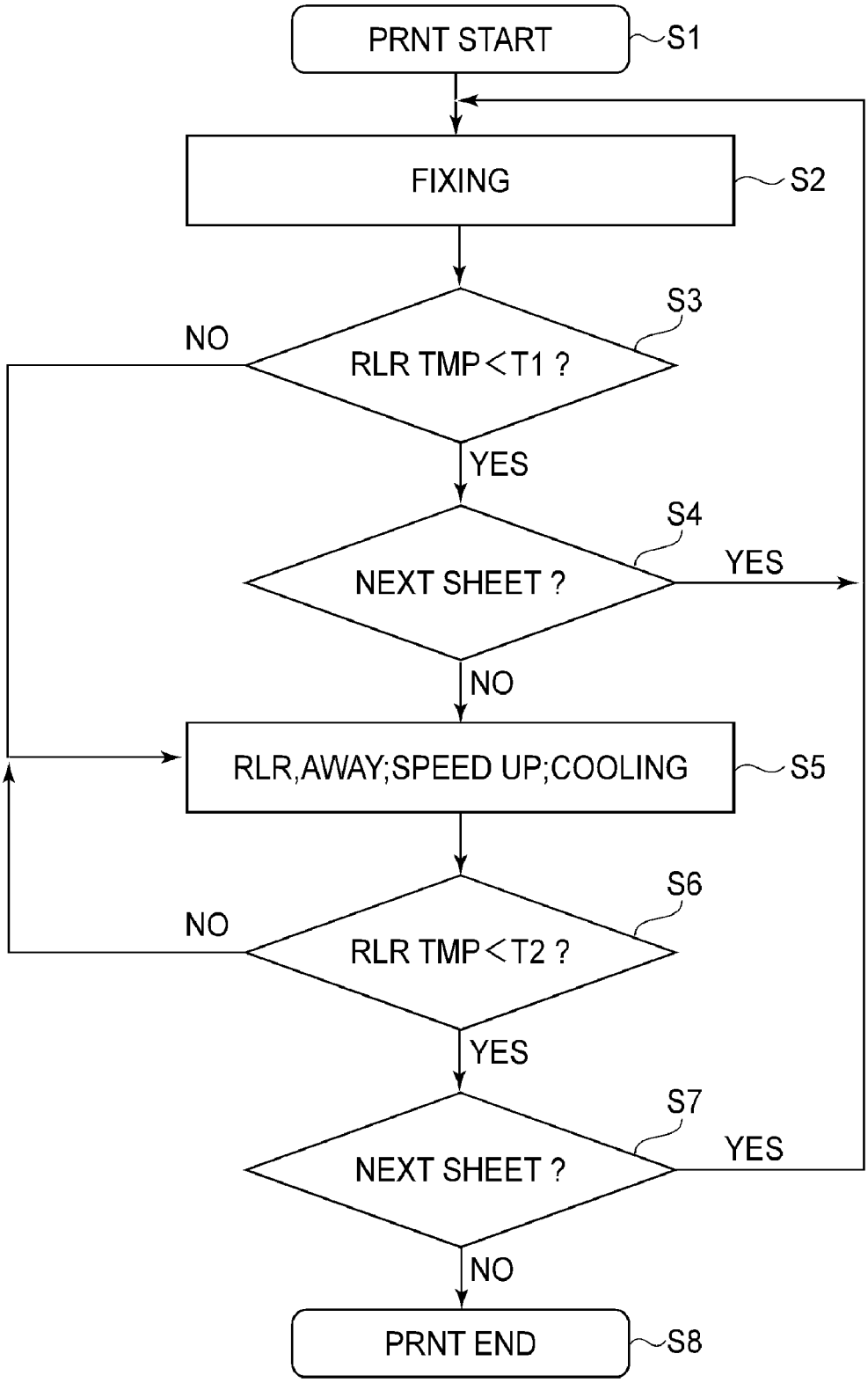
FIG. 4 is a flowchart of the fixing operation of the fixing apparatus in the first embodiment of the present invention.

FIG. 4 is a flowchart of the image fixing process of the fixing apparatus 10. As the image forming apparatus 200 becomes ready for image formation (or while it is kept on standby), the controller 38 sends a print start signal to the recording medium conveyance mechanism, and an unfixed toner image is formed on the recording medium P. Then, the recording medium P is conveyed to the fixing apparatus 10 (S1).

Then, the controller 38 sends a fixation operation start signal to the fixing apparatus 10, which is kept on standby, causing thereby the fixing apparatus 10 to begin fixation (S2), and the pressure roller 52 is placed in contact with the fixation roller 51.

As soon as an image is fixed to the recording medium P, the controller 38 determines whether or not the temperature of the pressure roller 52 is no higher than the top limit T1 of a preset temperature range for the pressure roller 52 (S3). If the answer is YES (temperature of pressure roller 52 has not reached top limit T1), the controller 38 uses an unshown sensor to determine whether or not the next recording medium P has begun to be conveyed (S4). Incidentally, that the temperature of the pressure roller 52 has not reached the top limit T1 of the preset temperature range for the pressure roller 52 means that the distance between the successive two recording mediums P is small enough for the heat transmitted from the fixation roller 51 to the pressure roller 52, to be sufficiently radiated through the recording media P. On the other hand, if the answer is NO (temperature of pressure roller 52 is higher than top limit T1), the controller 38 moves the pressure roller 52 away from the fixation roller 51, increases the pressure roller 52 in peripheral velocity, and places the fixing apparatus 10 (image forming apparatus 200) in the cooling mode, that is, the mode in which the pressure roller 52 is cooled (S5). In this embodiment, the controller 38 is given the role of operating the fixing apparatus (image forming apparatus 200) in the cooling mode. That the temperature of the pressure roller 52 is higher than the top limit T1 of the preset temperature range for the pressure roller 52 means that the distance between the successive two recording mediums P is too large for the heat transmitted from the fixation roller 51 to the pressure roller 52, to be sufficiently radiated through the recording media P. In an ordinary continuous image forming operation, the physical interval between successive two recording mediums is relatively small as described above. Therefore, it does not occur that the temperature of the pressure roller 52 reaches the top limit T1 of the preset temperature range for the pressure roller 52.

Then, the controller 38 determines whether or not the next recording medium P has begun to be conveyed (S4). If the answer is YES (next recording medium P has begun to be conveyed), the controller 38 instructs the fixing apparatus 10 to fix (heat) the toner on the recording medium P (S2). If the answer is NO (next recording medium P has not begun to be conveyed), the controller 38 moves the pressure roller 52 away from the fixation roller 51, increases the pressure roller 52 in rotational speed (peripheral velocity), and rotates the cooling fan 80 at its full speed to cool the pressure roller 52 (S5).

The controller 38 determines whether or not the temperature of the pressure roller 52 is no higher than the bottom limit T2 of the preset temperature range for the pressure roller 52 (S6). If the answer is YES (temperature of pressure roller 52 is lower than bottom limit T2), the controller 38 determines whether or not the next recording medium P has begun to be conveyed (S7). If the answer is NO (temperature of pressure roller 52 is higher than bottom limit T2), the controller 38 moves the pressure roller 52 away from the fixation roller 51, increases the pressure roller 52 in peripheral velocity, and rotates the cooling fan 80 at the full speed (S5), until the temperature of the pressure roller 52 reaches the bottom limit T2 (S5).

Then, the controller 38 determines whether or not the next recording medium P has begun to be conveyed (S7). If the answer is YES (next recording medium P has begun to be conveyed), the controller 38 makes the fixing apparatus 10 restart the fixing operation (S2). That is, as the pressure roller 52 is cooled enough for its temperature to decrease to the bottom limit, the pressure roller 52 is placed in contact with the fixation roller 51, and is changed in rotational speed to the speed at which the pressure roller 52 is to be rotated when the toner image on the recording medium P is heated in the fixation nip N. If the answer is NO (next recording medium P is not conveyed), the printing operation is ended (apparatus is put on standby) (S8). That is, the fixing apparatus 10 is structured so that the fixation roller 51 and pressure roller 52 can be placed in contact with, or separated from, each other.

Part (a) of FIG. 5 is a graphical time table which shows the difference between the fixing apparatus in this embodiment and a conventional fixing apparatus, in terms of the length of downtime in the cooling mode in which the image forming apparatus 200 is placed during one of the recording medium intervals. Part (b) of FIG. 5 is a graph which shows the temperature change which occurs to the pressure roller 52 during the recording medium intervals while recording media P are continuously conveyed through the fixing apparatus 10. The length of time and the number of recording mediums P in (a) and (b) of FIG. 5 are optional.

FIG. 6 is a table which shows the relationship among the length of cooling time, length of time the cooling fan 80 is operated, the rotational speed (peripheral velocity) of the pressure roller 52, and the length of time the pressure roller 52 is rotated at a higher speed. FIG. 6 includes the results of the changes of the cooling mode sequence of the image forming apparatus (change of peripheral velocity of pressure roller 52 in cooling mode).

FIG. 6 shows an example of an image forming apparatus operation in the cooling mode. More specifically, as the recording medium P, sheets of high quality paper, which was 128 g/m$^2$, were used. The rate of production was 50 prints (copies) per minute. The prints were continuously made at a rate of 50 prints (copies) per minute. FIG. 6 shows only the peripheral velocities at which the pressing member was driven in the cooling mode (during extended interval between successive two recording mediums P), and the length of time the cooling means were driven. During the fixation, the peripheral velocity of the fixation roller 51 and that of the pressure roller 52 were 250 mm/sec. After the separation of the pressure roller 52 from the fixation roller 51, the peripheral velocity of the pressure roller 52 was made faster than 250 mm/sec; it was switched to 500 mm/sec, 750 mm/sec, or 1,000 mm/sec, any of which may be selected according to the durability of the pressure roller 52 and pressure belt 53. There needs to be only a single second driving speed for the pressure roller (pressure belt) of the fixing apparatus.

The peripheral velocity of 500 mm/sec, which is one of the peripheral velocities at which the pressure roller 52 is to be rotated after the separation of the pressure roller 52 from the fixation roller 51, is twice the peripheral velocity at which the pressure roller 52 is rotated during the fixation. The peripheral velocity of 750 mm/sec, at which the pressure roller 52 is rotated after the separation of the pressure roller 52 from the fixation roller 51, is three times the peripheral velocity at which the pressure roller 52 is rotated during the fixation. The peripheral velocity of 1,000 second/sec, at which the pressure roller 52 is rotated after the separation of the fixation roller 51, is four times the peripheral velocity at which the pressure roller 52 is rotated during the fixation. The target temperature range for the pressure roller 52 was set so that the lowest and highest levels were 100° C. and 150° C., respectively. Incidentally, FIG. 6 includes the setting of the peripheral velocity at which the pressure roller 52 was driven after its separation from the fixation roller 51. The peripheral velocity of 250 mm/sec, at which the pressure roller 52 was driven after its separation from the fixation roller 51 is the same as that at which the pressure roller 52 is driven during the fixation.

The solid line in (a) FIG. 5 shows the changes which occurred to the surface temperature of the pressure roller 52 after the pressure roller 52 was increased in peripheral velocity from the preset peripheral velocity at which the pressure roller 52 was to be rotated, according to the present invention, to cool the pressure roller 52. The broken line shows the changes which occurred to the temperature of the pressure roller 52 while the pressure roller 52 was rotated at the same peripheral velocity as that at which the pressure roller 52 is to be rotated during the fixation.

It is evident from (a) and (b) of FIG. 5, and FIG. 6 that the present invention can substantially reduce the downtime of the fixing apparatus 10, that is, the length of time from the starting of the cooling of the pressure roller 52 to the ending of the cooling of the pressure roller 52, reducing thereby the length of time it takes to finish an image forming operation.

As described above, in this embodiment, the peripheral velocity at which the pressure roller 52 is to be rotated while the image forming apparatus 200 is operated in the cooling mode is made faster than the peripheral velocity at which the pressure roller 52 is to be rotated during a period in which the pressure roller 52 is used for actual fixation. As a result, it took less time to cool the pressure roller 52. Therefore, it took less time to finish an image forming operation. In other words, this embodiment improves the image forming apparatus 200 in overall productivity.

Also in this embodiment, even while the image forming apparatus was operated in the cooling mode, the peripheral velocity of the fixation roller 51 was kept the same as, or less than, the peripheral velocity at which the fixation roller 51 was rotated during a period in which the fixation roller 51 is used for actual fixation. There was a problem that the air flow generated by the cooling fan 80 partially flowed toward the fixation roller 51. It is virtually impossible to prevent this problem. Since the fixation roller 51 is continuously controlled in temperature, it does not occur that the fixation roller 51 reduces in temperature because of the abovementioned stray air flow from the cooling fan 80. However, it is not desired for the fixation roller 51 to be unnecessarily cooled. Therefore, it is desired that while the image forming apparatus 200 is in the cooling mode, the peripheral velocity of the fixation roller 51 is kept no higher than the peripheral velocity at which the fixation roller 51 is rotated during a period in which it is used for actual fixation, and the peripheral velocity of the pressure roller 52 is made as fast as possible compared to the peripheral velocity at which the pressure roller 52 is rotated during a period in which it is used for actual fixation.

Embodiment 2

FIG. 7 is a sectional view of the fixing apparatus 20 in the second embodiment of the present invention, and shows the structure of the apparatus 20. The structural features of the fixing apparatus 20, which are the same as those of the fixing apparatus 10 are given the same reference characters as those given to the counterparts of the fixing apparatus 10, and will not be described. The image forming apparatus 200 in this embodiment has the fixing apparatus 20 instead of the fixing apparatus 10. Referring to FIG. 7, in terms of basic structure, the fixing apparatus 20 is the same as the fixing apparatus 10 in that it also employs a fixation roller and a pressure roller. However, the fixing apparatus 20 is different from the fixing apparatus 10 in that it has a heat radiation roller 81 in addition to the aforementioned two rollers. The heat radiation roller 81 is a cooling means. It is a roller which is placed in contact with the pressure roller 52 to take heat from the pressure roller 52.

The heat radiation roller 81 is a hollow roller which is made of aluminum, and is 20 mm in external diameter. However, it does not need to be formed of aluminum. That is, it may be formed of any substance, for example, copper, which is excellent in heat conductivity. The heat radiation roller 81 is connected to a heat radiation roller moving mechanism, which is in connection to a pressure roller condition controlling means 38*b* of the controller 38. If it is necessary to cool the pressure roller 52, the controller 38 places the heat radiation roller 81 in contact with the pressure roller 52 by driving the heat radiation roller moving mechanism 39. If it is unnecessary to cool the pressure roller 52, the controller 38 moves the heat radiation roller 81 away from the pressure roller 52 by driving the heat radiation roller moving mechanism 39. In other words, the heat radiation roller moving mechanism 39 is a mechanism for placing the heat radiation roller 81 in contact with the pressure roller 52, or moving the heat radiation roller 81 away from the pressure roller 52.

FIG. 8 is a plan view of the pressure roller 52 as seen from the direction of the fixation roller 51. Referring to FIG. 8, the heat radiation roller 81 is provided with a cooling fin 82, which is at one of the lengthwise ends of the heat radiation roller 81. The cooling fin 82 is kept cool by a cooling fan 83, which is a means for blowing air upon the cooling fin 82. It is not mandatory that the fixing apparatus 20 is provided with the cooling fan 83, which is dedicated to the cooling of the cooling fin 82. That is, the cooling fin 82 may be disposed in the internal heat discharge duct of the image forming apparatus 200. The fixing apparatus 20 is structured so that the heat radiation roller 81 can be placed in contact with, or moved away from, the peripheral surface of the pressure roller 52 by the heat radiation roller moving mechanism 39.

FIG. 6 includes the relationship among the length of cooling time, the length of time the heat radiation roller 81 was operated, the rotational speed (peripheral velocity) of the pressure roller 52, and the length of time the pressure roller 52 is rotated at a higher speed. FIG. 6 includes also the results of the changes of the cooling mode sequence of the image forming apparatus 200 (change of peripheral velocity of pressure roller 52 in cooling mode).

Referring to FIG. 7, when it is necessary to cool the pressure roller 52, the pressure roller 52 is moved away from the fixation roller 51, and the heat radiation roller 81 is placed in contact with the pressure roller 52. Further, the peripheral velocity of the pressure roller 52 is increased to reduce the length of time necessary to cool the pressure roller 52.

As the temperature of the pressure roller 52 reaches the top limit T1 or bottom limit T2 of the target temperature range for the pressure roller 52, the fixing apparatus 20 is controlled virtually in the same manner as is the fixing apparatus 10 in the first embodiment is controlled, except that in this embodiment, the cooling fan 83 is activated, and at the same time, the heat radiation roller 81 is placed in contact with the peripheral surface of the pressure roller 52. It was confirmed that the effects of this embodiment were similar to those of the first embodiment.

Embodiment 3

FIG. 9 is a sectional view of the fixing apparatus 30 in the third embodiment of the present invention, and shows the structure of the apparatus 30. The structural features of the fixing apparatus 30, which are the same as those of the counterparts of the fixing apparatus 10 are given the same reference characters as those given to the counterparts, and will not be described. In the third embodiment, the image forming apparatus 200 is provided with the fixing apparatus 30 instead of the fixing apparatus 10. Referring to FIG. 9, the fixing apparatus 30 is provided with a pressure belt 53 instead of the pressure roller 52. The pressure belt 53 is an endless belt, as a pressure applying member, which is a part of a "pressure application unit". It is suspended, and kept stretched, by multiple (three) rollers 55-57. The fixing apparatus 30 is structured so that the outward surface of the pressure belt 53 is kept in contact with the fixation roller 51 by a belt pressing mechanism 69, which is a part of the "pressure application unit". More specifically, the belt pressing mechanism 69 has a pressure pad 170 and a pressure pad supporting portion 171, and is on the inward side of the loop which the pressure belt 53 forms. The pressure belt 53 is pressed upon the fixation roller 51 by the pressure pad 170, which presses upon the pressure belt 53 by being pressed upon the inward surface of the pressure belt 53, effecting thereby a fixation nip N. The fixation roller 51 in this embodiment is the same as the fixation roller 51 in the first embodiment. The pressure belt 53 is rotationally moved by the rotation of the fixation roller 51 in the direction indicated by an arrow mark.

The pressure belt 53 is made of a substrate layer and an elastic layer, and a surface layer. The substrate layer is formed of a resinous substance such as polyimide, or a metallic substance such as nickel. The elastic layer is formed of silicone, fluorinated rubber, or the like, and covers the peripheral surface of the substrate layer. The elastic layer may be covered with a surface layer formed of a fluorinated resin such as PFA, which is in the form of a piece of tube, and is 10-100 μm in thickness.

The pressure belt 53 is suspended and kept stretched by the rollers 55-57. The roller 56 functions as a separation roller and is formed of a metallic substance. It is pressed against the fixation roller 51, with the presence of the pressure belt 53 between the roller 56 and fixation roller 51, with the application of such an amount of pressure that the pressure belt 53 is virtually embedded in the fixation roller 51. Thus, the elastic layer of the fixation roller 51 is resiliently deformed. Thus, as the recording medium P is conveyed through the fixation nip N, it is subjected to the force generated by the elastic layer of the pressure belt 53 in the direction to separate the recording medium P from the peripheral surface of the fixation roller 51.

The pressure pad 170 is made of a base plate and an elastic portion. The base plate is formed of a metallic substance. The elastic portion is formed of an elastic substance such as silicone rubber, fluorinated rubber, or the like, and is attached to the base plate. It is pressed against the fixation roller 51 with the presence of the pressure belt 53 between it and the fixation roller 51. It is common practice to place a slippery member between the pressure pad 170 and pressure belt 53, or coat the inward surface of the pressure belt 53 with lubricant, in order to allow the pressure belt 53 to easily slide on the pressure pad 170.

As described above, the fixation roller 51, the endless pressure belt 53, and the pressure pad 170 form a fixation nip N, in which the pressure belt 53 appears as if it partially wraps around the fixation roller 51. This fixation nip N is substantially wider than the fixation nip N formed by the fixing apparatus 10. Thus, the fixing apparatus 30 is superior to the fixing apparatuses in the preceding embodiment, in terms of operational speed, and also, in terms of the effectiveness with which toner can be fixed to thick paper or the like recording medium.

Further, the separation roller 56 is pressed against the fixation roller 51 in such a manner that the separation roller 56 is virtually embedded in the surface layer (elastic layer) of the fixation roller 51. Therefore, the fixing apparatus 30, that is, the fixing apparatus in this embodiment, is superior to the fixing apparatuses in the preceding embodiments in terms of the separation of the recording medium P from the fixation roller 51, and also, is advantageous from the standpoint of increasing the fixing apparatus (image forming apparatus) in operational speed. The cooling fan 80 in this embodiment, which is a "fan" as a cooling apparatus, is disposed in a position in which it can efficiently cool the pressure belt 53 as is the cooling fan 80 of the fixing apparatus 10 in the first embodiment to efficiently cool the pressure roller 52. The cooling fan 80 in this embodiment is controlled by the controller 38 as is the cooling fan 80 in the first embodiment.

FIG. 6 mentioned above includes the relationship among the rotational speed (peripheral velocity) of the pressure belt 53 in the cooling mode, the length of time the pressure belt 53 is operated in the cooling mode, and the length of time the cooling fan 30 is operated in the cooling mode. FIG. 6 shows also the results of the changes of the cooling mode sequence of the image forming apparatus 200 (the change of the peripheral velocity of the pressure roller 52 in the cooling mode). Also in this embodiment, the pressure belt 53 of the fixing apparatus 30 is rotated at the first rotational speed (first driving speed), which is for fixing toner to recording medium P, as is the pressure roller 52 of the fixing apparatus 10 in the first embodiment. Next, referring to FIG. 10, when it is necessary to cool the pressure belt 53, the pressure belt 53 is moved away from the fixation roller 51, and is increased in peripheral speed to the second rotational speed (second driving speed), which is higher than the first rotational speed. Therefore, the length of time necessary to cool the pressure belt 53 is reduced. FIG. 10 is a sectional view of the fixing apparatus 30, and shows the process for placing the pressure belt 53 in contact with, or moving the pressure belt 53 away, from the fixation roller 51.

As the temperature of the pressure belt 53 reaches the top limit T1, or bottom limit T2, of the target temperature range for the pressure belt 53, the fixing apparatus 30 is controlled in the same manner as the fixing apparatus 10 is controlled as shown in FIG. 4, which is a flowchart of the operation for cooling the pressure roller 52 in the first embodiment. It was confirmed that the effects of this embodiment were similar to those of the first embodiment. Incidentally, the temperature of the pressure belt 53 is sensed by the temperature sensor 93, and determined by a temperature detecting means 38*a*.

Further, the fixing apparatus 30 is structured so that the pressure belt 53 slides against the pressure pad 170 while being pressed upon the fixation roller 51 by the pressure pad 170. Therefore, it is possible that the friction between the pressure belt 53 and pressure pad 170 will cause the pressure belt 53 to slip relative to the fixation roller 51. The friction between the pressure belt 53 and pressure pad 170 increases as the slippery substance, of which the pressure pad 170 is made, and pressure belt 53 increases in temperature. Therefore, keeping the temperature of the pressure belt 53 low is important to prevent the pressure belt 53 from slipping.

Embodiment 4

FIG. 11 is a sectional view of the fixing apparatus 40 in the fourth embodiment of the present invention, and shows the structure of the fixing apparatus 40. The structural features of the fixing apparatus 40, which are the same as those of the counterparts of the fixing apparatuses 10, 20, and 30 are given the same reference characters as those given to the counterparts, and will not be described. In the third embodiment, the image forming apparatus 200 is provided with the fixing apparatus 40 instead of the fixing apparatus 10. Referring to FIG. 11, the fixing apparatus 40 is provided with a heat radiation roller 81 (the cooling device, the heat radiating member), instead of the cooling fan 80 of the fixing apparatus 30 in the third embodiment. The heat radiation roller 81 is positioned where it can efficiently cool the pressure belt 53, as is the cooling fan 80 of the fixing apparatus 30. The heat radiation roller 81 is controlled by the controller 38 as is the cooling fan 80 of the fixing apparatus 30 controlled.

FIG. 6 includes the relationship between the rotational speed (peripheral velocity) of the pressure belt 53 of the fixing apparatus 40, and the length of time the pressure belt 53 is rotated in the cooling mode. Further, FIG. 6 shows the results of the changes (of the peripheral velocity of the pressure belt 53 in the cooling mode) of the cooling mode sequence of the image forming apparatus in this embodiment. Referring to FIG. 11, also in the case of the fixing apparatus 40, or the fixing apparatus in the fourth embodiment, when it is necessary to cool the pressure belt 53, the length of time necessary to cool the pressure belt 53 is reduced by moving the pressure belt 53 away from the fixation roller 51, and increasing the peripheral velocity of the pressure belt 53, as in the case of the fixing apparatuses 10 and 30.

As the temperature of the pressure belt 53 reaches the top limit T1, or bottom limit T2, of the target temperature range for the pressure belt 53, the fixing apparatus 40 is controlled in the similar manner to the manner in which the fixing apparatus 10, or the fixing apparatus in the first embodiment, is controlled as shown in FIG. 4, which is a flowchart of the operation for cooling the toner image pressing means in the first embodiment. It was confirmed that the effects of this embodiment were similar to those of the first embodiment.

Further, the fixing apparatus 40 is structured so that the heat radiation roller 81 can be placed in contact with, or moved away from, the outward surface of the pressure belt 53. Further, it is controlled in a similar manner to the manner in which the counterpart of the fixing apparatus 10 is controlled as shown in FIG. 4, which is the flowchart of the recording medium pressing means cooling operation in the first embodiment. The effectiveness of the fixing apparatus 40 was similar to those of the fixing apparatus 10.

FIG. 12 is a sectional view of a fixing apparatus 50, which is an example of a modified version of the fixing apparatus 40 in the fourth embodiment. It shows the structure of the fixing apparatus 50. Referring to FIG. 12, the fixing apparatus 50 is structured so that the heat radiation roller 81 can be placed in contact with, or moved away from, the inward surface of the pressure belt 53. This fixing apparatus 50 may be controlled based on a control flow, which is roughly similar to the control flow for the fixing apparatus 10. With the use of this structural arrangement and the control sequence, not only can the same effects as those obtained by the fixing apparatus 10, but also, the recording medium P is prevented from being contaminated with toner, paper dusts traceable to the recording medium P, etc. Further, the toner pressing means cooling means of the fixing apparatus 50 remains effective longer than those in the preceding embodiments.

As described above, in the case of the first to fourth embodiments, the length of time necessary for cooling the toner pressing member is reduced by making the peripheral velocity at which the pressing member is rotated when the fixing apparatus is in the cooling mode, greater than the peripheral velocity at which the pressing member is rotated when the fixing apparatus is actually fixing a toner image.

In the case of each of the fixing apparatuses 10, 20, 30, 40, and 50, that is, the image fixing apparatuses in the first to fourth embodiments of the present invention, if the temperature of the "pressing member" is higher than a preset level, the "pressing member" is moved away from the fixation roller 51, and is driven at the second driving speed, which is greater than the first driving speed. As the "pressing member" is rotated faster than the fixation roller 51, air flow is generated in the adjacencies of the "pressing member". Therefore, the body of warm (hot) air, which is created by the heat radiated from the "pressing member" is quickly replaced by a body of cool air. Thus, the heat of the "pressing member" is efficiently radiated. Therefore, even if the physical intervals with which multiple recording media P are conveyed through the fixing apparatuses 10, 20, 30, 40, and 50 when the image forming apparatuses 200 are in the continuous printing mode, are increased, the length of time necessary to cool the "pressing member" is decreased. In other words, the fixing apparatuses are reduced in downtime. That is, the present invention can provide a fixing apparatus, such as the fixing apparatuses 10, 20, 30, 40, and 50, which is significantly higher in productivity than any of the conventional fixing apparatuses.

Further, each of the fixing apparatuses 10, 20, 30, 40, and 50, that is, the fixing apparatuses in the first to fourth embodiments, has a cooling apparatuses for cooling the "pressing member". It has also the pressing member condition controlling means 38*b*, which cools the "pressing member" by driving the "cooling apparatus" during the entirety, or a part, of the period in which the "pressing member" is driven at the second driving speed. In other words, when the image forming apparatus 200 is in the cooling mode, not only is the "pressing member" driven at the second driving speed, but also, the "pressing member" is cooled by the "cooling apparatus". Therefore, the body of air, which robbed thermal energy from the surface of the "pressing member" efficiently flows away. Thus, the "pressing member" is efficiently cooled.

There are conventional fixing apparatuses, whose "pressing members" can be changed in steps in their rotational speed. For example, there are conventional fixing apparatuses, whose fixing means can be changed in peripheral velocity so that the peripheral velocity at which the fixing means are driven when ordinary recording paper (64 g/m$^2$, for example, in basis weight) is used as the recording medium can be made different from the peripheral velocity at which the fixing means are driven when thick paper (150 g/m$^2$, for example, in basis weight) is used as the recording medium. These fixing apparatuses are structured so that when ordinary paper is used, the peripheral velocity of the fixing means is set to 250 mm/sec; thick paper, 125 mm/sec; and when very thick paper is used, the peripheral velocity of the fixing means is set to 83 mm/sec, for example. In the case of these fixing apparatuses, the rotation of their fixing members when ordinary paper is used as the recording medium is sometimes referred to as the "normal velocity rotation"; the rotation of their fixing members when thick paper is used as the recording medium is sometimes referred to as "½ velocity rotation". Further, the rotation of the fixing members when very thick paper is used as recording member is sometimes referred to as "⅓ velocity rotation". Assuming that any of the above described conventional fixing apparatuses is used to fix images to the recording medium P, and the rotational speed of the "pressing member" is set to the normal speed, if the "pressing member" needs to be cooled, the rotational speed of the "pressing member" is set to a high speed. More specifically, assuming that the fixing apparatus is structured so that the rotational speed of its "pressing member" can be set to one of the three speed levels as described above, if the fixing apparatus is put in the cooling mode after the image fixation to thick paper, the pressing means is cooled by changing the fixing members in rotational speed from ½ to the normal one, whereas if the fixing apparatus is put in the cooling mode after the image fixation to the very thick paper, the fixing member is cooled by changing the fixing member in rotational speed from ⅓ to the normal one. With the employment of this operational arrangement, it can be expected that the length of time necessary to cool the pressing member reduces similarly to the above described manner. That is, the length of time necessary to cool the pressing member when the fixing apparatus is in the cooling mode can be reduced by selecting the highest speed as the rotational speed for the pressing member from among the multiple rotational speeds, including the one for the normal fixing operation, for the pressing member.

FIG. 15 shows how the basis weight of recording medium can be inputted using the control panel. FIG. 15 shows the case in which an operator is inputting information that "heavy 2 (very thick paper)" is in the "cassette 1". "Plain" means "ordinary paper". "Heavy 2" means "thick paper". An operator can print on very thick paper by placing sheets of very thick paper in cassette 1, and selecting cassette 1 before starting printing.

According to the first and third embodiments, the "pressing member" is cooled by the air which is blown upon the "pressing member" by the cooling fan 80. Therefore, the fixing apparatuses in these embodiments are higher in the efficiency with which heat is radiated outward from a "pressing member" than a fixing apparatus (conventional fixing apparatus), whose user has to wait until its 'pressing member" is reduced in temperature by the natural heat radiation after the internal heater of the "pressing member" is turned off.

According to the second and fourth embodiments, the heat radiation roller 81 comes into contact with the "pressing member". Therefore, the internal heat of the "pressing member" is efficiently transmitted to the heat radiation roller 81. Thus, the "pressing member" is improved in heat radiation efficiency.

According to the second embodiment, the cooling fan 82 is attached to the shaft of the "pressing member". Therefore, as the "pressing member" rotates, the cooling fan 82 also rotates. Thus, the "pressing member" is further improved in the efficiency with which it is cooled.

According to the third and fourth embodiments, the fixing apparatus employs the pressure belt 53 as the "image heating member". Further, the fixation roller 51 is the "image heating member". Therefore, the pressure belt 53 is efficiently cooled while it is circularly moved.

In the first to fourth embodiments, the fixing apparatuses are structured so that their fixation rollers 51 are on or above their "pressing members". However, the first to fourth embodiments are not intended to limit the present invention in scope. In other words, the fixing apparatuses may be structured so that their fixation rollers 51 are under their "pressing members".

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 114531/2009 filed May 11, 2009 which is hereby incorporated by reference.

What is claimed is:

1. An image forming apparatus comprising:

a rotatable image heating member configured to heat a toner image on a recording material in a nip;

a rotatable pressing member configured to press against said image heating member to form the nip;

a mechanism configured to space said image heating member and said pressing member from each other;

a temperature detecting member configured to detect the temperature of said pressing member;

a cooling device configured to cool said pressing member;

a rotational speed changing mechanism configured to change the rotational speed of said pressing member; and an executing portion configured to execute, when the temperature of said pressing member reaches an upper limit temperature during execution of an image formation job of continuously forming images, a cooling mode for cooling said pressing member by said cooling device in a state that said pressing member and said heating member are spaced from each other while rotating said pressing member at a second rotational speed higher than a first rotational speed which is a speed during the execution of the job.

2. An apparatus according to claim 1, further comprising a controller configured to control an image forming operation, wherein said controller disables an image forming operation when said pressing member rotates at the second rotational speed.

3. An apparatus according to claim 1, wherein said mechanism contacts said pressing member and said image heating member to each other, and wherein when the temperature reaches a lower limit temperature which is lower than the upper limit temperature, said image heating member and said pressing member are brought into contact with each other, and the rotational speed of said pressing member is changed to a rotational speed preset for heating the toner image on the recording material in the nip.

4. An apparatus according to claim 1, wherein said pressing member includes a belt member.

5. An apparatus according to claim 1, wherein a cooling position where said cooling device cools said pressing member is upstream of a temperature detection position where said temperature detecting member detects the temperature of said pressing member with respect to a rotational direction of said pressing member.

6. An apparatus according to claim 1, wherein said cooling device is disabled during an image heating operation.

7. An image forming apparatus comprising:

a rotatable image heating member configured to heat a toner image on a recording material in a nip;

a rotatable pressing member configured to press against said image heating member to form the nip;

mechanism configured to space said image heating member and said pressing member from each other;

a temperature detecting member configured to detect the temperature of said pressing member;

a cooling device configured to cool said pressing member;

a rotational speed changing device configured to change the rotational speed of said pressing member;

a controller configured to execute a first image forming mode for an image forming operation with rotation of said pressing member at a first rotational speed and a second image forming mode for the image forming operation with rotation of said pressing member at a second rotational speed lower than the first rotational speed; and an executing portion configured to execute, when the temperature of said pressing member reaches an upper limit temperature during execution of an image formation job of continuously forming images in the second image forming mode, a cooling mode for cooling said pressing member by said cooling device in a state that said pressing member and said heating member are spaced from each other while rotating said pressing member at the first rotational speed.

8. An apparatus according to claim 7, wherein said executing portion executes, when the temperature of said pressing member reaches an upper limit temperature during execution of an image formation job of continuously forming the images in the first image forming mode, a cooling mode for cooling said pressing member by said cooling device in a state that said pressing member and said heating member are spaced from each other while rotating said pressing member at a third rotational speed higher than the first rotational speed.

9. An apparatus according to claim 8, wherein said controller disables the image forming operation when said pressing member rotates at the third rotational speed.

10. An apparatus according to claim 7, wherein said mechanism contacts said pressing member and said image heating member to each other, and, wherein when the temperature reaches a lower limit temperature which is lower than the upper limit temperature, said image heating member and said pressing member are brought into contact with each other, and the rotational speed of said pressing member is changed to the second rotational speed.

11. An apparatus according to claim 7, wherein said pressing member includes a belt member.

12. An apparatus according to claim 7, wherein a cooling position where said cooling device cools said pressing member is upstream of a temperature detection position where said temperature detecting member detects the temperature of said pressing member with respect to a rotational direction of said pressing member.

13. An apparatus according to claim 7, wherein said cooling device is disabled during image heating operation.

14. An image forming apparatus comprising:

rotatable image heating means for heating a toner image on a recording material in a nip;

rotatable pressing heating means for pressing against said image heating means to form the nip;

spacing means for spacing said image heating means and said pressing means from each other;

temperature detecting means for detecting the temperature of said pressing means;

cooling means for cooling said pressing member;

rotational speed changing means for changing the rotational speed of said pressing means; and executing means for executing, when the temperature of said pressing means reaches an upper limit temperature during execution of an image formation job of continuously forming images, a cooling mode for cooling said pressing means by said cooling means in a state that said pressing means and said heating means are spaced from each other while rotating said pressing means at a second rotational speed higher than a first rotational speed which is a speed during the execution of the job.

15. An image forming apparatus comprising:

rotatable image heating means for heating a toner image on a recording material in a nip;

rotatable pressing means for pressing against said image heating means to form the nip;

spacing means for spacing said image heating means and said pressing means from each other;

temperature detecting means for detecting the temperature of said pressing means;

cooling means for cooling said pressing means;

rotational speed changing means for changing the rotational speed of said pressing means;

controlling means for executing a first image forming mode for an image forming operation with rotation of said pressing means at a first rotational speed and a second image forming mode for the image forming operation with rotation of said pressing means at a second rotational speed lower than the first rotational speed; and executing means for executing, when the temperature of said pressing means reaches an upper limit temperature during execution of an image formation job of continuously forming images in the second image forming mode, a cooling mode for cooling said pressing means by said cooling means in a state that said pressing means and said heating means are spaced from each other while rotating said pressing means at the first rotational speed.

* * * * *